US007946872B2

(12) United States Patent
Taketomi et al.

(10) Patent No.: US 7,946,872 B2
(45) Date of Patent: May 24, 2011

(54) CABLE CONNECTOR

(75) Inventors: Kousuke Taketomi, Yamato (JP); Tomonari Kaneko, Kanagawa (JP); Atsuhito Horino, Ebina (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/302,412

(22) PCT Filed: May 31, 2007

(86) PCT No.: PCT/US2007/012780

§ 371 (c)(1),
(2), (4) Date: Jul. 30, 2009

(87) PCT Pub. No.: WO2007/142993

PCT Pub. Date: Dec. 13, 2007

(65) Prior Publication Data

US 2010/0029119 A1 Feb. 4, 2010

(30) Foreign Application Priority Data

May 31, 2006 (JP) ..... 2006-150779

(51) Int. Cl.
*H01R 13/62* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS

| | | | | |
|---|---|---|---|---|
| 6,089,905 | A | 7/2000 | Shimmyo et al. | |
| 7,112,079 | B2 * | 9/2006 | Miura et al. | 439/260 |
| 2006/0089045 | A1 | 4/2006 | Miura et al. | |

FOREIGN PATENT DOCUMENTS

| | | |
|---|---|---|
| WO | 2006015126 | 2/2006 |

* cited by examiner

*Primary Examiner* — Briggitte R Hammond
(74) *Attorney, Agent, or Firm* — Larry I. Golden

(57) ABSTRACT

A cable connector including a housing with an inserting hole adapted to receive a flat cable including terminals mounted on the housing that has contact parts to be electrically connected to lead wires of the flat cable. The connector includes an actuator having a main body moveable between a first position to enable insertion of the flat cable and a second position, parallel to the direction of insertion-and-extraction of the flat cable, to connect the lead wires of the flat cable to the contact parts. The actuator includes locked portions on opposite sides of the main body and the housing includes locking portions on opposite sides of the housing which are engaged with the locked portions when the actuator is in the second position. The locked portions include tip edges extending parallel to the direction of insertion-and-extraction of the flat cable when the actuator is in the second position and the locking portions include facing tip edges inclined to the direction of the insertion-and-extraction of the flat cable with the distance between facing tip edges of the locked portions being narrower at the inlet side of the inserting hole. The actuator is mounted to permit rearward shifting movement when the flat cable is not received within the inserting hole which displaces the relative alignment between locked portions and locking portions thereby permitting easier opening of the actuator for insertion of the cable while also providing a secure lock when connection is made with the flat cable.

8 Claims, 11 Drawing Sheets

CABLE CONNECTOR

BACKGROUND OF THE INVENTION

The present invention relates to a connector for a cable. Conventionally, in order to connect flat cables, being often referred to as a flexible printed circuit (FPC) or a flexible flat cable (FFC), and each having flexibility, a connector for a cable (hereinafter referred to as "cable connector") such as an FPC connector and an FFC connector has been used (for example, refer to Utility Model Registration No. 3094560).

FIG. 14 is a perspective view indicating a conventional cable connector.

As shown in FIG. 14, the cable connector includes a housing 301 being formed of an insulating material such as synthetic resin or the like, and a plurality of first terminals 303 and a plurality of second terminals 304, being formed of conductive material such as metal or the like, and being held by the housing 301. On the upper surface of the housing 301, an actuator 302 being formed of insulating material such as synthetic resin or the like is disposed. The actuator 302 is rotatably mounted on the housing 301 and rotates between its open position as shown in the figure and its closed position as not shown in the figure. In this case, in a state in which the actuator 302 is situated in the open position, a flat cable 305 is inserted from opening parts of the housing 301. When the flat cable 305 is inserted into the back of the opening part, the actuator 302 is then rotated up to the closed position, by being operated by operator's fingers or the like. Then, locking portions 308 of fixing brackets 307 mounted on the housing 301 get to the state of hanging over locked portions 306 of the actuator 302, and this renders the actuator 302 to be locked in the housing 301. Thus, the flat cable 305 is pressurized from above by the actuator 302, and a connecting portion being exposed on the lower surface of the flat cable 305 is brought into contact with the first terminals 303 and the second terminals 304 to become conductive, and thereby the position of the actuator 302 is fixed.

However, in the conventional cable connector, if the amount of hanging of the locking portions 308 of the fixing brackets 307 over the locked portions 306 is increased in order to ensure locking of the actuator 302, the amount of resiliently displacing the locking portions 308 is increased when the actuator 302 is rotated up to the closed position, and therefore, strong force is required, making it difficult to operate the actuator 302. On the other hand, if the amount of hanging of the locking portions 308 over the locked portions 306 is decreased in order to facilitate the operation in rotating the actuator 302 up to the closed position, unlocking of the actuator 302 will be facilitated, and therefore, when the external force such as vibration, shock or the like is added, the actuator 302 may be unnecessarily rotated up to the open position, resulting in disengagement of the flat cable 305.

SUMMARY OF THE INVENTION

It is an object of the present invention, in order to solve the above-mentioned problem encountered by the conventional cable connector, to provide a cable connector capable of facilitating the operation of changing the orientation of the actuator to the second position, and also capable of ensuring the locking of the actuator and assuredly connecting the flat cable without any unnecessary change in orientation of the actuator from the second position. This is accomplished by virtue of a simple construction, by inclining, to the direction of insertion-and-extraction of the cable, the tip edges of the locking portions engaged with the locked portions being disposed on both sides of the actuator that is mounted on a housing so as to be able to change its orientation between a first position capable of inserting a flat cable and a second position to electrically connect lead-wires of the inserted flat cable and terminals thereof.

To this end, a cable connector of the present invention comprises: a housing provided with an inserting hole through which a flat cable is inserted; a terminal mounted on the housing and provided with a contact part to be electrically connected to a lead-wire of the flat cable; an actuator capable of changing its orientation between a first position to enable insertion of the flat cable and a second position to connect the lead-wires of the inserted flat cable to the contact part, the actuator having a main body nearly parallel to a direction of insertion-and-extraction of the flat cable in the second position, and locked portions being disposed on both sides of the main body; and locking portions being disposed on both sides of the housing and being engaged with the locked portions in the second position, wherein, tip edges of the locked portions are parallel to the direction of insertion-and-extraction of the flat cable in the second position, and tip edges of the locking portions are inclined to the direction of insertion-and-extraction of the flat cable.

In a cable connector in accordance with another aspect of the present invention, the tip edges of the locking portions on both sides face each other, and a mutual distance becomes narrower as being situated nearer an inlet side of the inserting hole.

In a cable connector in accordance with a further aspect of the present invention, the tip edges of the locking portions on both sides face each other and are resiliently displaceable in a direction to widen a mutual distance.

In a cable connector in accordance with another aspect of the present invention, the tip edges of the locking portions on both sides are displaced obliquely above.

In a cable connector in accordance with yet another aspect of the present invention, the locking portions are formed as part of auxiliary connector securing members being mounted on both sides of the housing.

In a cable connector in accordance with a further aspect of the present invention, the locking portions hang over the locked portions in the second position.

In a cable connector in accordance with another aspect of the present invention, the actuator is movable toward a back of the inserting hole in the second position and in the position adjacent to the second position, when the flat cable is not inserted into the inserting hole.

In a cable connector in accordance with another aspect of the present invention, the actuator is subjected to the force toward the back of the inserting hole in the position adjacent to the second position, when the tip edges of the locked portions abut on the tip edges of the locking portions.

In a cable connector in accordance with a further aspect of the present invention, the actuator is provided with a pressing part pressing the flat cable against the contact part, and is unmovable toward the back of the inserting hole in the second position and in the position adjacent to the second position, when the flat cable is inserted into the inserting hole.

In a cable connector in accordance with another aspect of the present invention, the actuator is mounted to permit rearward shifting movement when the flat cable is not received within the inserting hole which displaces the relative alignment between locked portions and locking portions thereby permitting easier opening of the actuator for insertion of the cable while also providing a secure lock when connection is made with the flat cable.

According to the present invention, the cable connector includes the tip edges of the locking portions which are inclined to the direction of insertion-and-extraction of the flat cable with the tip edges of the locking portions engaged with the locked portions being disposed on both sides of the actuator that is mounted on the housing so as to be able to change the orientation of the actuator between the first position capable of inserting the flat cable and the second position to electrically connect the lead-wire of the inserted flat cable and the terminals thereof. In spite of a simple construction, this enables the connector to facilitate the operation of changing the orientation of the actuator to the second position, and also to ensure the locking of the actuator, thereby enabling it to assuredly connect the flat cable without any unnecessary change in the orientation of the actuator from the second position.

Other objects, features and advantages of the invention will be apparent from the following detailed description taken in conjunction with the accompanying drawings.

DESCRIPTION OF THE PREFERRED EMBODIMENTS

Preferred embodiments of the present invention will be described below in detail with reference to the accompanying drawings.

Figure 1:
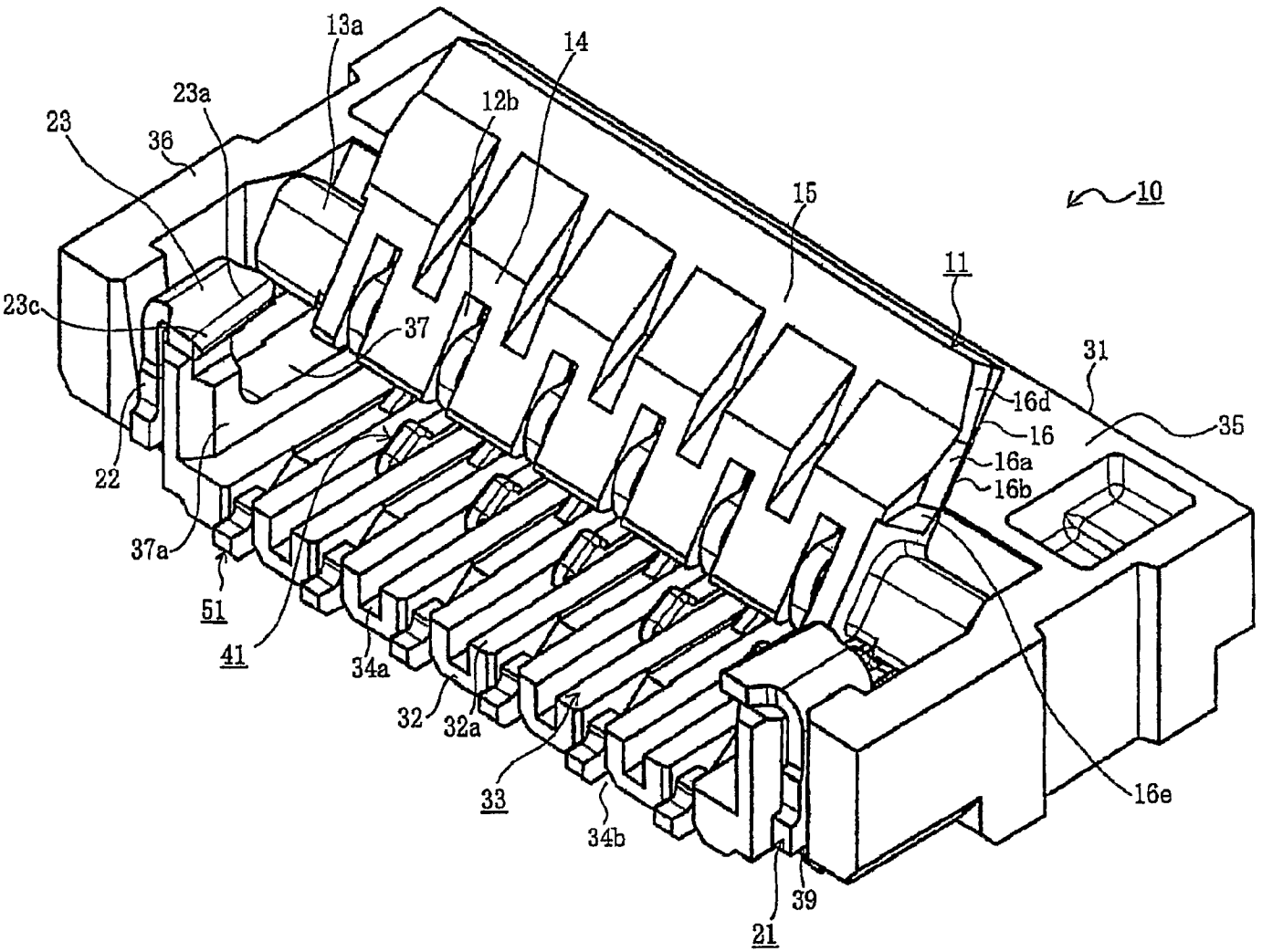
FIG. 1 is a perspective view when an actuator of a cable connector in a preferred embodiment of the present invention is in the open position.
Figure 2:
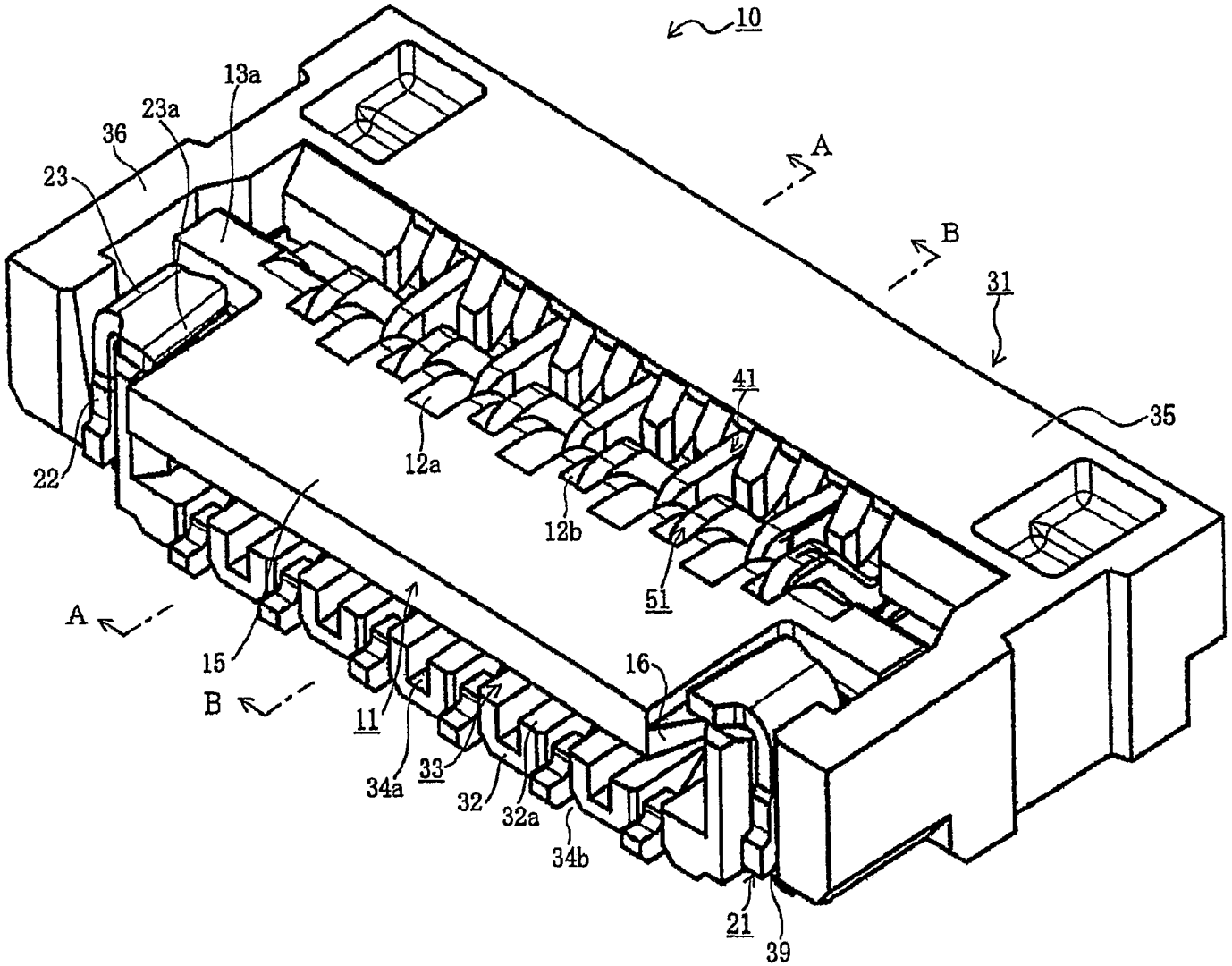
FIG. 2 is a perspective view when the actuator of the cable connector in a preferred embodiment of the present invention is in the closed position.
Figure 3:
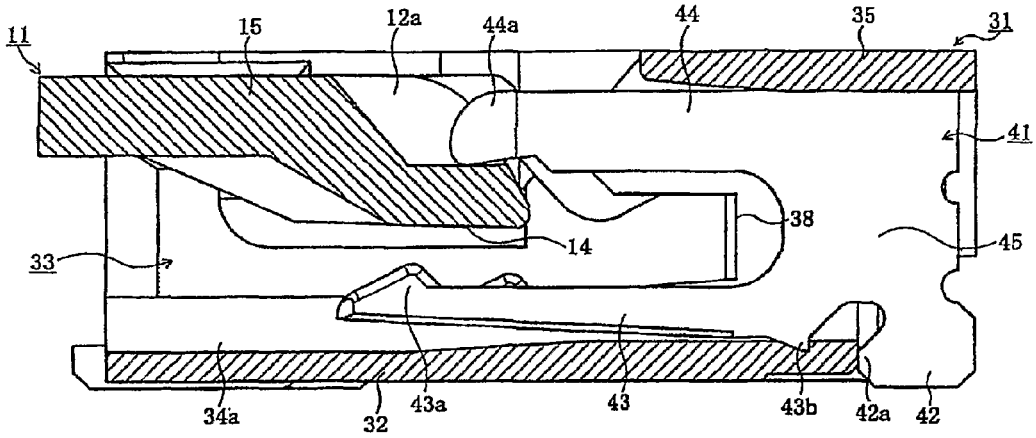
FIG. 3 is a cross-sectional view when the actuator of the cable connector in a preferred embodiment of the present invention is in the closed position, and an arrowed line sectional view A-A in FIG. 2.
Figure 4:
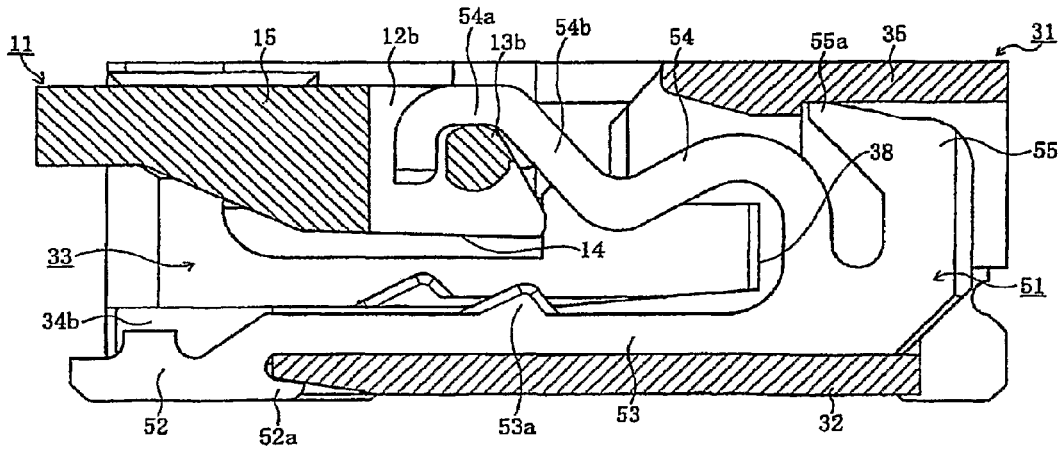
FIG. 4 is a cross-sectional view when the actuator of the cable connector in a preferred embodiment of the present invention is in the closed position, and an arrowed line sectional view B-B in FIG. 2.

FIG. 1 is a perspective view when an actuator of a cable connector in a preferred embodiment of the present invention is in the open position. FIG. 2 is a perspective view when the actuator of the cable connector in a preferred embodiment of the present invention is in the closed position. FIG. 3 is a cross-sectional view when the actuator of the cable connector in a preferred embodiment of the present invention is in the closed position, and an arrowed line sectional view A-A in FIG. 2. FIG. 4 is a cross-sectional view when the actuator of the cable connector in a preferred embodiment of the present invention is in the closed position, and an arrowed line sectional view B-B in FIG. 2.

In these figures, a reference numeral 10 designates a connector as a cable connector in the preferred embodiment, and the connector 10 is mounted on a surface of a substrate such as a circuit board or the like (not illustrated), and is used for electrically connecting a flat cable 71, which will be described later, being referred to as a flexible circuit board, a flexible flat cable or the like. In this case, the lower surface as viewed in FIGS. 3 and 4 is a mounting surface of the connector 10, which is mounted to the mounting surface of the substrate. For example, the flat cable 71 is a flat flexible cable being called as an FPC, an FFC or the like, and any kind of cable is acceptable if it is a flat cable provided with lead-wires such as lead-wires 75 to be described later. In this embodiment, representations of directions such as up, down, left, right, front, rear, and the like, used for explaining the structure and movement of each part of the cable connector 10, are not absolute, but relative. These relative directions are appropriate when each part of the cable connector 10 is in the position shown in the figures. If the orientation of each part of the cable connector 10 changes, however, it is assumed that these relative positions are to be changed according to the change in the orientation of each part of the connector 10.

The connector 10 comprises a housing 31 being integrally formed of insulating material such as synthetic resin or the like, and an actuator 11 being integrally formed of insulating material such as synthetic resin or the like, and being mounted on the housing 31 so as to be able to change its angular orientation. That is, the actuator 11 is mounted on the housing 31 so as to change its orientation to be situated in the open position as a first position and in the closed position as a second position.

The housing 31 includes a lower part 32, an upper part 35, right and left side parts 36, and inserting holes 33 being formed among the lower part 32, the upper part 35 and the side parts 36, and serving as opening parts for inserting and extracting an end portion of the flat cable 71 from the front (the left side as viewed in FIGS. 3 and 4). The flat cable 71 is inserted toward the right side as viewed in FIGS. 3 and 4. In this embodiment, for the sake of convenience, it is determined that each inlet side of the inserting holes 33 (the left side as viewed in FIGS. 3 and 4) is referred to as the front side of the connector 10, and each back of the inserting holes 33 (the right side as viewed in FIGS. 3 and 4) is referred to as the rear side of the connector 10. At the backs within the inserting holes 33, an abutting part 38 on which the tip of the flat cable 71 abuts is disposed.

In the housing 31, a plurality of terminal receiving grooves are formed in which metal terminals are fitted. In the present preferred embodiment, the terminals include a first terminal 41 and a second terminal 51, and each of the terminal receiving grooves includes a first terminal receiving groove 34*a* in which the first terminal 41 is fitted, and a second terminal receiving groove 34*b* in which the second terminal 51 is fitted. In the example as shown in the drawings, the terminal receiving grooves in even-number positions are the first terminal receiving grooves 34*a*, and the terminal receiving grooves in odd-number positions are the second terminal receiving grooves 34*b*. For example, eleven pieces of the first terminal receiving grooves 34*a* and the second terminal receiving grooves 34*b* are formed in total at a pitch of about 0.3 mm. The pitch and the number of the terminal receiving grooves can be suitably changed. The first terminal receiving grooves 34*a* and the second terminal receiving grooves 34*b* are alternately disposed so as to be adjacent to each other. Further, the first terminals 41 and the second terminals 51 are not always required to be fitted in all the first terminal receiving grooves 34*a* and second terminal receiving grooves 34*b*, and it is possible to suitably reduce the number of first terminals 41 and the number of second terminals 51, as determined by the arrangement of the lead-wires 75 contained in the flat cable 71.

In addition, side shoulder portions 37 are formed adjacent to the side portions 36 on both sides of the lower portion 32. The side shoulder portions 37 are shoulder portions extending in the direction of inserting and extracting the flat cable 71, that is, in the direction of insertion-and-extraction of the flat cable 71, and the upper surfaces thereof are situated in a higher position than the upper surface 32*a* of the lower portion 32. And, in the side shoulder portions 37, slit-shaped auxiliary securing member receiving recess portions 39 extending in the direction of insertion-and-extraction of the flat cable 71 are formed, and auxiliary connector securing members 21 being commonly known as nails are inserted into the auxiliary securing member receiving recess portions 39, thereby being mounted on the housing 31.

Preferably, the auxiliary connector securing members 21 are formed by providing a metal plate with machining such as punching, bending, or the like. Each of the auxiliary connector securing members 21 includes a flat main body 22 extending in the direction of insertion-and-extraction of the flat cable 71 and in the direction vertical to the mounting surface, and a locking portion 23 being integrally connected to the upper edge of the front end of the main body 22 and extending in a direction parallel to the mounting surface. The locking portion 23 is formed by bending a member projecting above from the upper edge of the front end of the main body 22 so that the tip edge 23*a* may be directed to the inside of the housing 31. Consequently, the right and left locking portions 23 are formed so that each other's tip edge 23*a* are facing each other. In addition, since the locking portions 23 are integrally connected to the main body 22 through bending portions, the locking portions 23 can resiliently be deformed to a certain degree, and the right and left tip edges 23*a* can be displaced in the right and left direction.

Each of the tip edges 23*a* has a linear visible outline 23*b*, and the visible outline 23*b* is formed so as to be inclined to the direction of insertion-and-extraction of the flat cable 71. More particularly, the tip edge 23*a* is formed so that the part may be inclined to a center line extending in the anteroposterior direction of the housing 31 on the surface parallel to the mounting surface, and the extension line thereof may cross the center line ahead of the housing 31. The right and left locking portions 23, including the tip edges 23*a*, are disposed so as to be symmetric to the center line. Thus, the distance between the right and left tip edges 23*a* is wider at the backs of the inserting holes 33, namely at the rear side, and narrower at the inlet sides of the inserting holes 33, namely at the front side. The side surfaces 37*a* of the right and left side shoulder portions 37, and the front side ends of the tip edges 23*a* function as the guides of the inserting holes 33.

At each of the tip edges 23*a*, a C-surface 23*c* extending to the visible outline 23*b* can be formed within the board thickness thereof. The dimension of the C-surface 23*c* is, while associating with locked portions 16 of the actuator 11 to be described later, suitably determined depending on selection of the locking force and the unlocking force. The C-surface can prevent the locked portions 16 from becoming worn, and can also make initial movements of locking and unlocking to be unimpeded.

Also, the auxiliary connector securing members 21 have mounting portions (not illustrated), and the mounting portions are fixed on the surface of the substrate by soldering or the like. This reinforces the fixing of the connector 10 to the substrate, preventing the connector 10 from disengaging from the substrate. In addition, the upper end surfaces situated behind the locking portions 23 in the main body 22 of the auxiliary connector securing members 21 function as a supporting part for supporting first shafts 13*a* formed on both sides of the main body 15 of the actuator 11 from below.

Thus, the actuator 11 includes the main body 15 being a rectangular thick plate member, a plurality of terminal accommodating recess parts being formed in the main body 15, the first shafts 13*a* are formed so as to project outward from both sides of the main body 15, the plate-like locked portions 16 being formed so as to project outward from both sides of the main body 15, as in the case of the first shafts 13*a*, and pressing parts 14 being disposed on the lower face of the main body 15. The pressing parts 14 press the flat cable 71 being inserted through the inserting holes 33 downwardly, namely toward the direction of the mounting surface, when the actuator 11 is situated in the closed position. The pressing parts 14 enable insertion of the flat cable 71 when the actuator 11 is situated in the open position.

Each of the terminal accommodating recess parts contains a first terminal accommodating recess part 12*a* accommodating a backstop 44*a* at the tip of an upper arm part 44 of the first terminal 41, and a second terminal accommodating recess part 12*b* accommodating a bearing part 54*a* at the tip of an upper arm part 54 of the second terminal 51. The number and the position of the first terminal accommodating recess parts 12*a* and second terminal accommodating recess parts 12*b* correspond to the first terminal receiving grooves 34*a* and second terminal receiving grooves 34*b*. In addition, as shown in FIG. 4, a second shaft 13*b* as the shaft of the actuator 11 is disposed in each of the second terminal accommodating recess parts 12*b*, and the second shafts 13*b* are engaged with the bearing parts 54*a*. The upward shift of the second shafts 13*b* is limited by the bearing parts 54*a*. Therefore, the bearing parts 54*a* prevent the actuator 11 from disengaging from the housing 31.

Then, as shown in FIG. 2, the main body 15 becomes approximately parallel to the direction of insertion-and-extraction of the flat cable 71 when the actuator 11 is situated in the closed position, and as shown in FIG. 1, the main body 15 forms an angle of 90 degrees or more with respect to the direction of insertion-and-extraction of the flat cable 71 when the actuator 11 is situated in the open position.

Furthermore, when the actuator 11 is situated in the closed position, the locked portions 16 are positioned forward from the first shafts 13*a* so as to engage with the locking portions 23. In this case, as shown in FIG. 2, the locking portions 23 hang over the locked portions 16, preventing the actuator 11 from changing its orientation from the closed position to the open position. That is to say, the locked portions 16 and the locking portions 23 function as locking mechanisms for locking the actuator 11 in the closed position and preventing the actuator 11 from being opened. The locked portions 16 are formed, coming down by one step from the outer side surfaces of the main body 15 so that the locking portions 23 may not project upward from the main body 15 of the actuator 11 when the tip edges 23*a* of the locking portions 23 hang over the locked portions 16 to lock the actuator 11. For that reason, it is possible to restrain the height of the connector 10. Now, the tip edges 16*a* of the locked portions 16 are perpendicular to the substrate surface on which the connector 10 is mounted, forming planar state parallel to the direction of insertion-and-extraction of the flat cable 71, and include visible outlines 16*b* being linear as viewed from the top side of the sheet of FIG. 5. That is to say, the tip edges 16*a* are parallel to the center line extending in an anteroposterior direction of the housing 31 on the surface parallel to the mounting surface.

Figure 6:
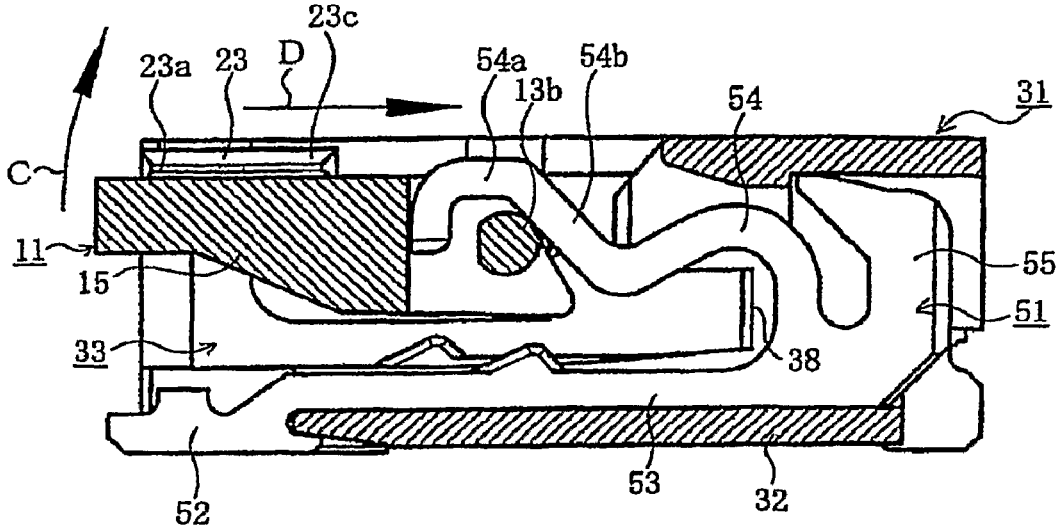
FIG. 6 is a sectional view depicting the movement of opening the actuator of the cable connector in a preferred embodiment of the present invention from the closed position thereof and also depicting sites similar to those in FIG. 4.
Figure 7:
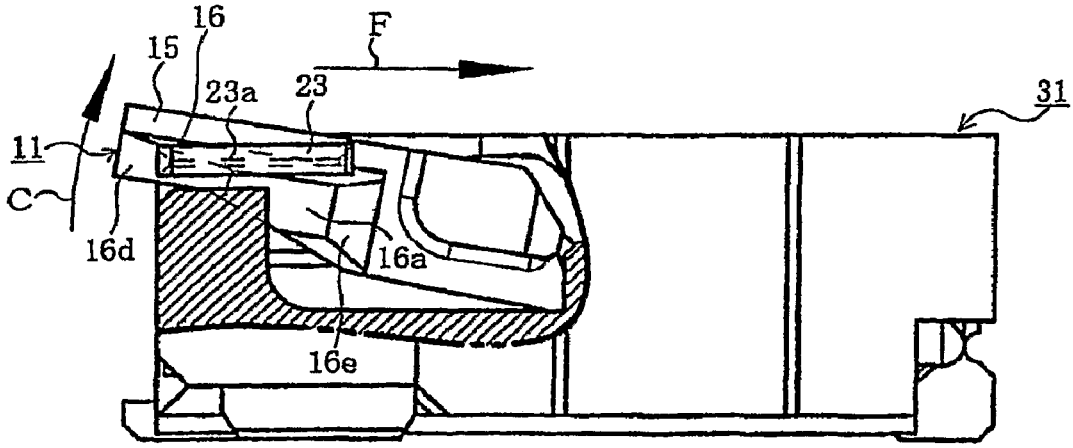
FIG. 7 is a partial sectional view depicting the movement of opening the actuator of the cable connector in a preferred embodiment of the present invention from the closed position thereof.

Each of the tip edges 16*a* contains an inclined surface 16*c* in its thickness direction from the main body 15 to the visible outline 16*b*, and inclined surfaces 16*d* and 16*e* back and forth as viewed from the direction of insertion-and-extraction of the flat cable 71. The inclined surfaces 16*c*, 16*d* and 16*e* can be suitably determined in association with the locking portions 23 by setting restraining movement thereof, for example, the operational ability of the actuator 11. In particular, in movement for opening the actuator 11 from the closed position as shown in FIGS. 6 and 7, inclined surfaces 16*d* can perform movement for opening the actuator 11 more smoothly when the inclined surfaces 16*d* and the visible outlines 23*b* of the locking portions 23 are in the overlapped position in the insertion direction of the flat cable 71. That is to say, it is because, at the time of moving the actuator 11 toward the terminal side in order to open the actuator 11, if the inclined surfaces 16*d* and the visible outlines 23*b* are in the overlapped position, the inclined surfaces 16*d* serve as a guide, and thereby hang over the visible outlines 23*b* when the actuator 11 is rotated upward.

Then, as shown in FIG. 3, each of the first terminals 41 has an approximately U shape, and contains a lower arm part 43 as a first arm part and an upper arm part 44 as a second arm part, extending in the direction of insertion-and-extraction of the flat cable 71, and a connecting part 45 extending in a direction perpendicular to the direction of insertion-and-extraction and linking the base part of the lower arm part 43 and the base part of the upper arm part 44.

At this moment, the lower arm part 43 functions as a contact piece electrically connected to the lead-wires 75 of the flat cable 71, and contains a contacting part 43*a* projecting in the vicinity of the tip thereof (the left end as viewed in FIG. 3). In addition, to the rear end of the connecting part 45, a tail part 42 is connected as a substrate connecting part, projecting downward and being connected to a connecting pad to be formed on the substrate surface by soldering or the like. Further, a projection 43*b* projecting downward is formed at the base part of the lower arm part 43, and an abutting part 42*a* is formed at the front end of the tail part 42.

When the actuator 11 is situated in the closed position, the backstops 44*a* at the tips of the upper arm parts 44 enter into the first terminal accommodating recess parts 12*a* and press the pressing part 14 downwardly, namely toward the direction of the mounting surface.

The first terminals 41 are then inserted and fitted in the first terminal receiving grooves 34*a* from the rear side of the housing 31 (the right side as viewed in FIG. 3). In this case, the upper arm parts 44 and approximately linear upper end parts of the connecting parts 45 abut on the lower surface of the upper part 35, the projections 43*b* grab the floor surfaces of the first terminal receiving grooves 34*a*, and further the abutting parts 42*a* abut on the rear end surface of the lower part 32, and thereby the first terminal 41 is fixed to the housing 31.

As shown in FIG. 4, each of the second terminals 51 contains a lower arm part 53 as a linear first arm part extending in the direction of insertion-and-extraction of the flat cable 71, an upper arm part 54 as a generally S-shaped second arm part, and a connecting part 55 extending in a direction perpendicular to the direction of insertion-and-extraction and being connected to a connecting portion between the base part of the lower arm part 53 and the base part of the upper arm part 54.

A tail part 52 is connected as a substrate connecting portion to the tip of the lower arm part 53 (the left end as viewed in FIG. 4). The tail part projects downward and is connected by soldering or the like to a connecting pad formed on the substrate surface. The lower arm parts 53 function as contact pieces being electrically connected to the lead-wires 75 of the flat cable 71, and contain contact parts 53*a* formed so as to project upward between the tip and the base part thereof Now, a projection 52*a* projecting backward is formed at the rear end of the tail part 52, and a projection 55*a* is formed at the upper edge of the front end of the connecting part 55.

The bearing part 54*a* at the tip of the upper arm part 54 is connected through the tilting part 54*b* formed so as to be situated obliquely above from the base part side to the tip side. And, the second shaft 13*b* of the actuator 11 is engaged with the bearing part 54*a*.

The second terminals 51 are inserted and fitted in the second terminal receiving grooves 34*b* from the front side of the housing 31 (the left side as viewed in FIG. 4). In this case, the approximately linear lower ends of the lower arm parts 53 abut on the floor surfaces of the second terminal receiving grooves 34*b*, the projections 55*a* grab the lower surface of the upper part 35, and further the projections 52*a* of the tail parts 52 grab the lower end of the front end surface in the lower part 32 of the housing 31. And thereby the second terminal 51 is fixed to the housing 31.

Meanwhile, in the first terminals 41, the tail parts 42 are situated at the rear end of the housing 31, whereas in the second terminals 51, the tail parts 52 are situated at the front end of the housing 31. Then, as described above, the first terminals 41 and the second terminals 51 are alternately fitted in the housing 31. For this reason, the alignment of the tail parts 42, the tail parts 52, and the connecting pads and the like being formed on the mounting surface of the substrate so as to correspond to said tail parts forms, when viewed from above the connector 10, a zigzag form alternately being off in a transverse direction with respect to the direction of alignment of terminals, namely a direction perpendicular to the figures in FIGS. 3 and 4. Therefore, even if a pitch between the first terminal 41 and the second terminal 51 adjacent to each other is narrow, it is possible to widen the distance between the tail part 42 and the tail part 52, and the distance between the connecting pads or the like corresponding to each of these tail parts. For this reason, it is possible to manufacture the connecting pads or the like with ease, and also to prevent generation of any solder bridge and prevent any short-circuit from arising between the adjacent connecting pads, at the time of soldering the tail part 42, the tail part 52, and connecting pads or the like corresponding to said tail parts.

Further, in each of the second terminals 51, the position of the contact part 53*a* with respect to the direction of insertion-and-extraction of the flat cable 71 is situated nearer the rear end of the housing 31 than the position of the contact part 43*a* in the first terminal 41. This aims for equalizing the electrical resistance at the first terminal 41 and the second terminal 51 by approximately equalizing the length of the electrically-conducting path from the contact part 43*a* to the tail part 42, to the length of the electrically-conducting path from the contact part 53*a* to the tail part 52. Since this separates the positions at which the adjacent lead-wires 75 of the flat cable 71 are electrically connected to the first terminals 41 and the second terminals 51 respectively, it enables to prevent the crosstalk between the adjacent lead-wires 75 from generating.

As shown in FIG. 1, when the actuator 11 is situated in the open position, the pressing parts 14 are directed obliquely upward. Since the distance between the actuator 11 and the contact part 43*a* of the first terminal 41, and the distance between the actuator 11 and the contact part 53*a* of the second terminals 51 are sufficiently wide, the end of the flat cable 71 being inserted from the inserting hole 33 is inserted without being subjected to any contact pressure or with being subjected to a slight contact pressure from the contact parts 43*a* and the contact parts 53. Therefore, a formation of ZIF (Zero Insertion Force) structure is thereby substantially realized.

Next, the movement of the actuator 11 will be described. Here, in a state in which the flat cable 71 is not connected, the movement of opening the actuator 11 from the closed position will be described.

Figure 5:
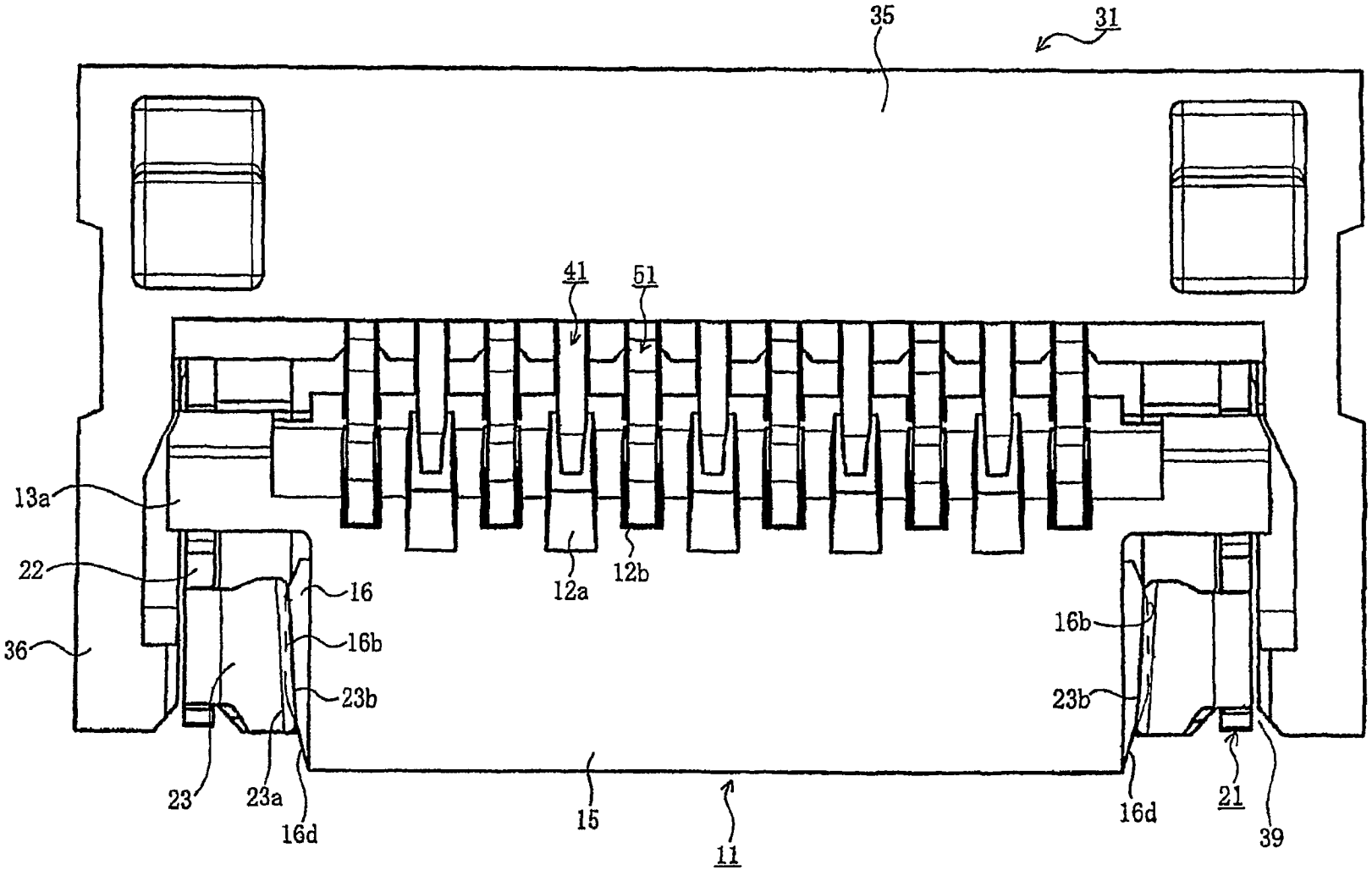
FIG. 5 is a top view when the actuator of the cable connector in a preferred embodiment of the present invention is in the closed position.
Figure 8:
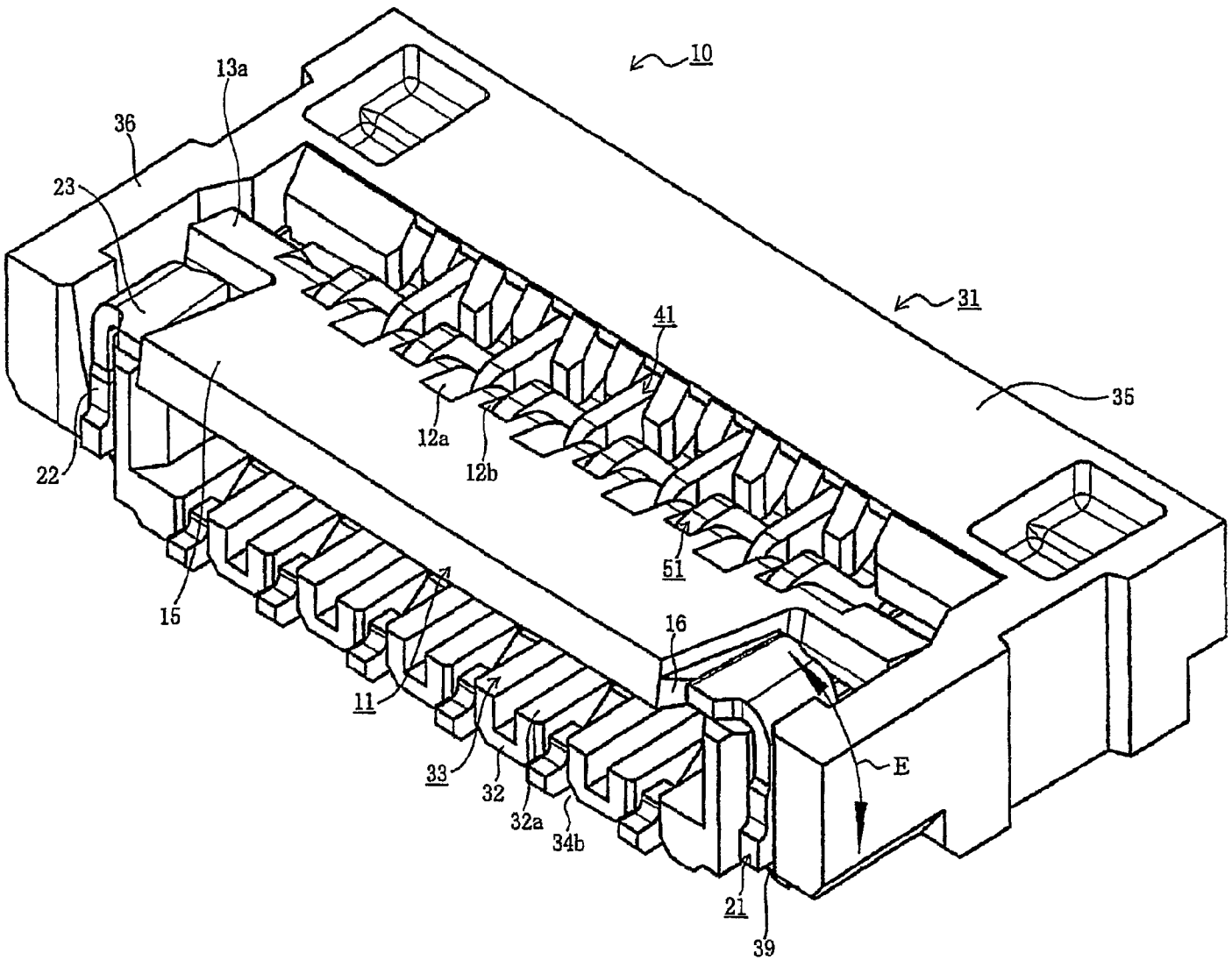
FIG. 8 is a perspective view depicting the movement of opening the actuator of the cable connector in a preferred embodiment of the present invention from the closed position thereof.

FIG. 5 is a top view depicting the state in which the actuator of the cable connector in the preferred embodiment of the present invention is situated in the closed position. FIG. 6 is a cross-sectional view depicting the movement of opening the actuator of the cable connector in a preferred embodiment of the present invention from the closed position thereof, and also depicting sites similar to those in FIG. 4. FIG. 7 is a partial sectional view depicting the movement of opening the actuator of the cable connector in a preferred embodiment of the present invention from the closed position thereof. FIG. 8 is a perspective view depicting the movement of opening the actuator of the cable connector in a preferred embodiment of the present invention from the closed position thereof.

In the present embodiment, the tail parts 42 of the first terminals 41 and the tail parts 52 of the second terminals 51 are connected by soldering to the conductive pads or the like being formed on the surface of the substrate, and the mounting parts of the auxiliary connector securing members 21 are connected by soldering to the connecting pads being formed on the surface of the substrate, and thereby the connector 10 is mounted on the surface of a substrate such as a circuit board or the like.

In a state in which the flat cable 71 is not connected, the actuator 11 is situated in the closed position, as shown in FIG. 5. Since the locking portions 23 hang over the locked portions 16 being formed on the both sides of the main body 15 of the actuator 11, the actuator 11 is locked in the closed position. This prevents the actuator 11 from being unnecessarily opened, even if the external force such as vibration, shock, or the like is added on the connector 10. For example, in conveying a substrate on which the connector 10 is mounted into a heating furnace and rendering reflow soldering to the substrate, the unnecessary opening of the actuator 11 can be certainly prevented, even if the connector 10 conveyed along with the substrate receives vibration from a conveyer for conveyance.

In reference to FIG. 5, it is possible to easily understand the relationship between the tip edges 16*a* of the locked portions 16 parallel to the center line extending in an anteroposterior direction of the housing 31 and the tip edges 23*a* of the locking portions 23 being inclined to the center line extending in an anteroposterior direction of the housing 31.

When the operator manipulates the actuator 11 with fingers or the like to open the same, the force in the direction indicated by the arrow D is added on the front end of the main body 15 of the actuator 11 along with the force in the direction indicated by the arrow C in FIG. 6. The main body 15 is moved toward the rear side of the connector 10 by the force in the direction indicated by the arrow D. In a state in which the flat cable 71 is not connected, since the main body 15 is movable down below the position shown in FIG. 4, the second shafts 13*b* move along the lower ends of the tilting parts 54*b* of the second terminals 51, and thereby the main body 15 can move as a whole toward the rear side of the connector 10. Then, since the locked portions 16 of the main body 15 move to the rear sides of the locking portions 23, namely to the side at which the distance between the right and left tip edges 23*a* is wide, the amount of hanging of the locking portions 23 over the locked portions 16 decreases. The actuator is mounted to permit this rearward shifting movement when the flat cable is not received within the inserting hole. This movement displaces the relative alignment between the locked portions and the locking portions when the actuator is in the second position making it easier to move the actuator to the first position when the cable is not inserted in the hole.

Also, the front end of the main body 15 is raised by the force in the direction indicated by the arrow C, and the main body 15 inclines to the insertion direction of the flat cable 71, as shown in FIGS. 7 and 8. Since the locked portions 16 being formed on both sides situated nearer the front end of the main body 15 are raised with respect to the locking portions 23, the distance between the right and left tip edges 23*a* is spread out by the locked portions 16. In this case, since the locking portions 23 are resiliently deformable to a certain degree, and the right and left tip edges 23*a* are displaceable in the direction indicated by the arrow E in FIG. 8, the distance between the right and left tip edges 23*a* may be spread by being pushed by the locked portions 16.

Thereafter, when the tip edges 16*a* of the locked portions 16 abut on the tip edges 23*a* of the locking portions 23, the tip edges get to the state of being resiliently pinched by the right and left tip edges 23*a*. At this moment, since the tip edges 23*a* incline to the center line extending in an anteroposterior direction of the housing 31, and the distance between the right and left tip edges 23*a* is wider on the rear side thereof, the tip edges 16*a* of the locked portions 16 are subjected to the force in the direction indicated by the arrow F in FIG. 7 by the pinching force of the right and left tip edges 23*a*. This causes the locked portions 16 to be moved to the rear side of the locking portions 23, and thereby the amount of hanging of the locking portions 23 over the locked portions 16 further reduces. Consequently, since the hanging of the locking portions 23 over the locked portions 16 is released relatively easily, and lock of the actuator 11 is released, it is possible to open the actuator 11 from the closed position.

The movement of connecting the flat cable 71 to the connector 10 will be described below.

Figure 9:
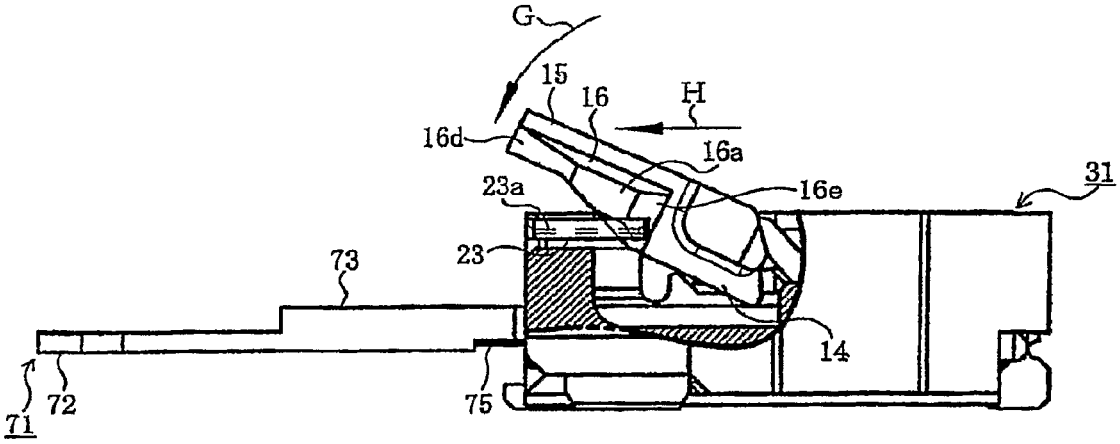
FIG. 9 is a partial sectional view depicting the movement of situating the actuator of the cable connector in a preferred embodiment of the present invention in the closed position thereof.
Figure 10:
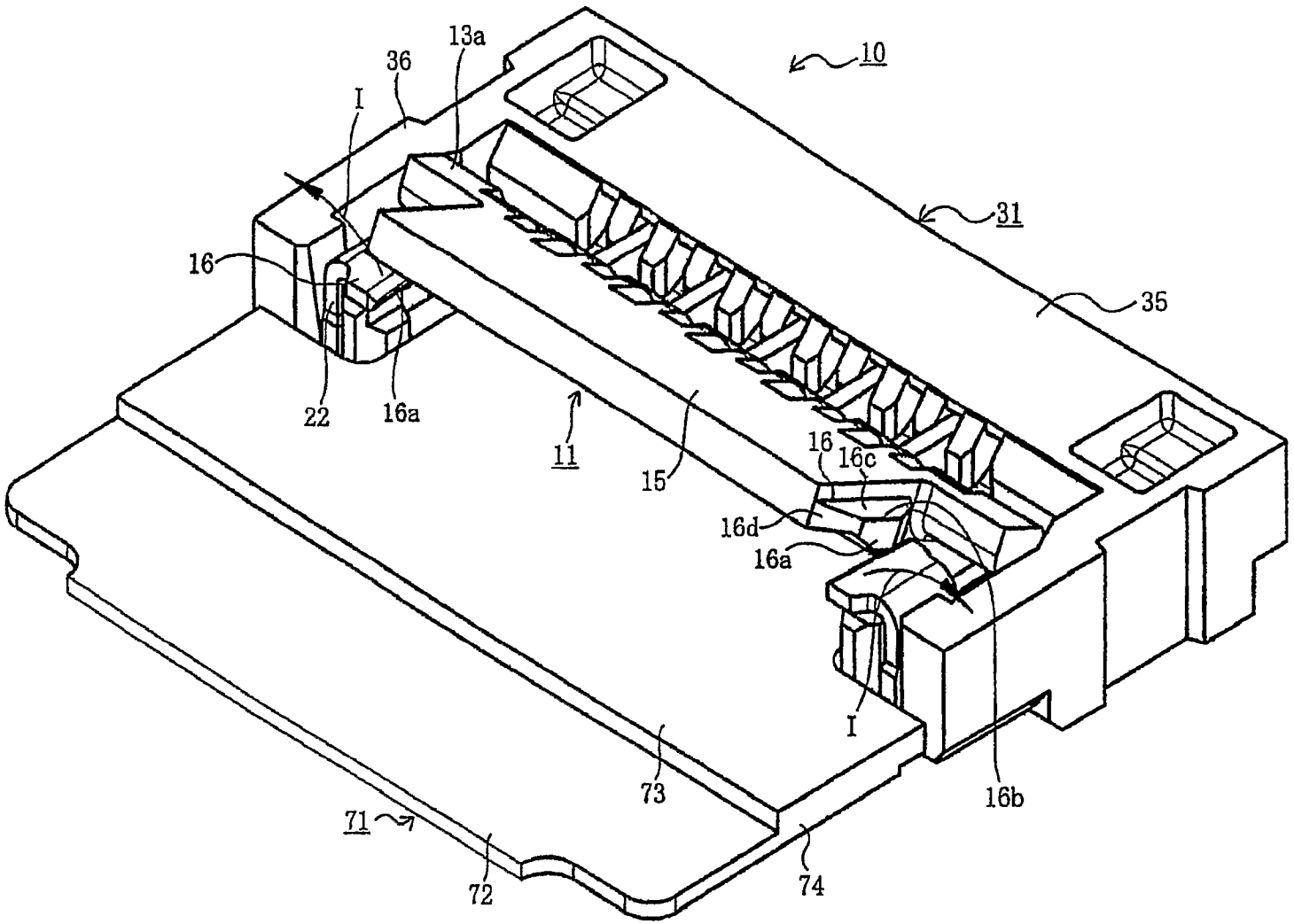
FIG. 10 is a perspective view depicting the movement of situating the actuator of the cable connector in a preferred embodiment of the present invention in the closed position thereof.
Figure 11:
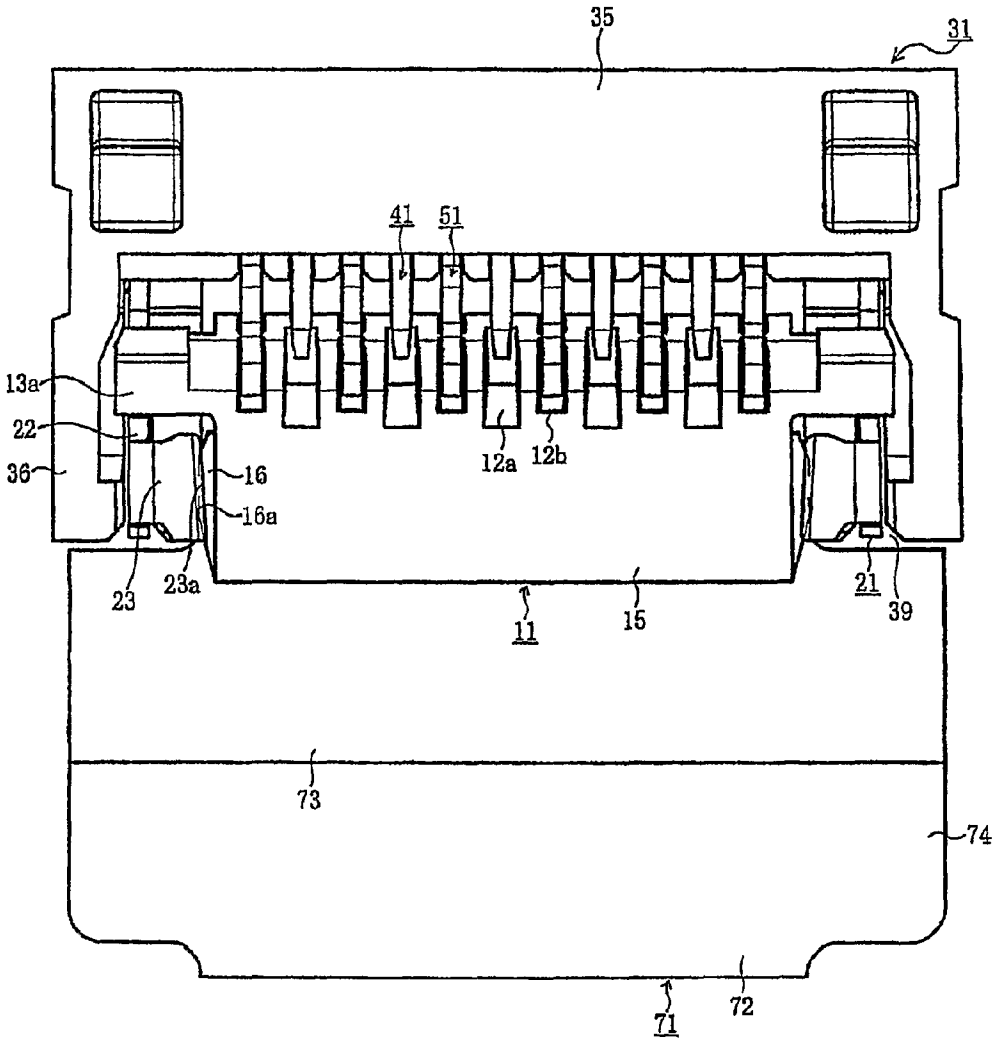
FIG. 11 is a top view depicting a state in which a flat cable is connected to the cable connector in a preferred embodiment of the present invention.
Figure 12:
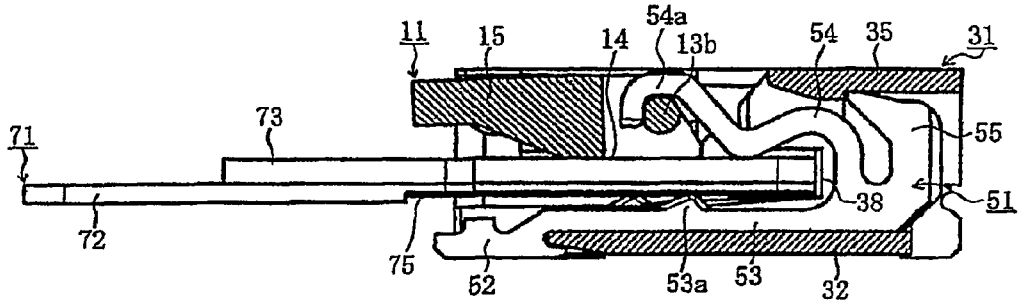
FIG. 12 is a sectional view depicting the state in which the flat cable is connected to the cable connector in a preferred embodiment of the present invention and also depicting sites similar to those in FIG. 4.
Figure 13:
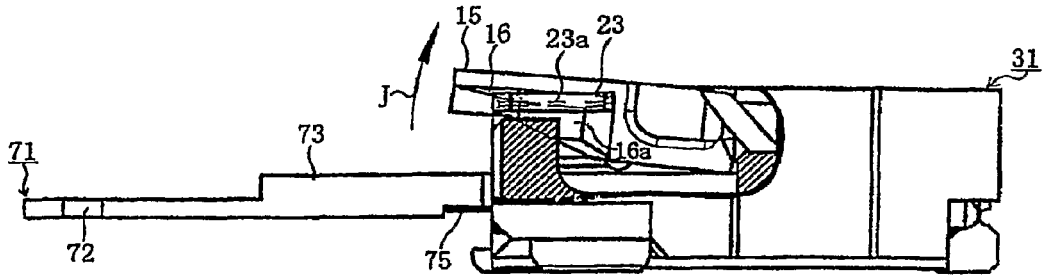
FIG. 13 is a perspective view depicting the movement of opening the actuator of the cable connector in a preferred embodiment of the present invention with the flat cable connected thereto, from the closed position.
Figure 14:
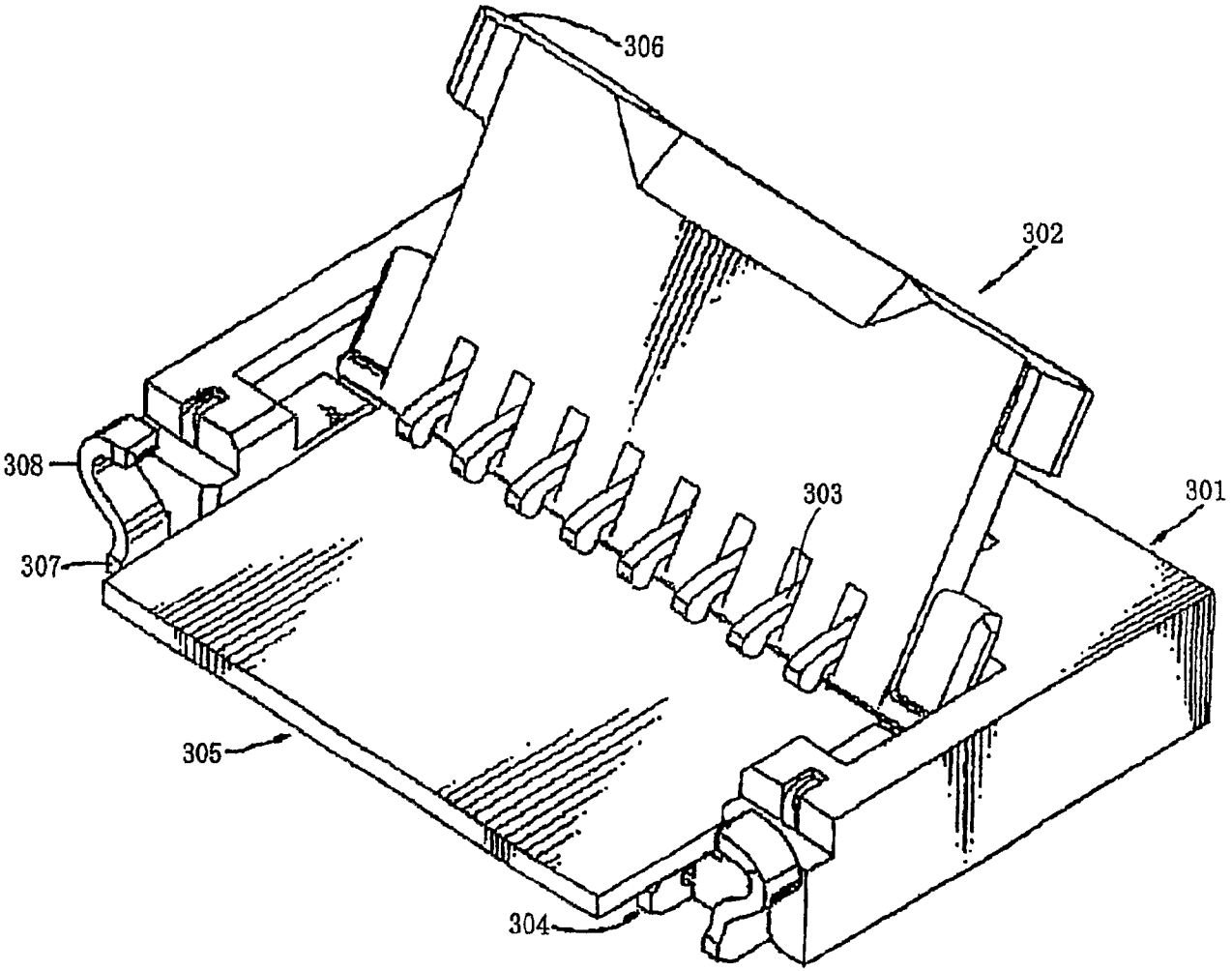
(Prior art) FIG. 14
FIG. 14 is a perspective view depicting a conventional cable connector.

FIG. 9 is a partial cross-sectional view depicting the movement of situating the actuator of the cable connector in a preferred embodiment of the present invention in the closed position. FIG. 10 is a perspective view depicting the movement of situating the actuator of the cable connector in a preferred embodiment of the present invention in the closed position. FIG. 11 is a top view depicting a state in which a flat cable in a preferred embodiment of the present invention is connected to the cable connector. FIG. 12 is a sectional view depicting the state in which the flat cable in a preferred embodiment of the present invention is connected to the cable connector, and also depicting the view similar to that shown in FIG. 4. FIG. 13 is a perspective view depicting the movement of opening the actuator of the cable connector in a preferred embodiment of the present invention with the flat cable connected thereto, from the closed position.

The flat cable 71 has herewith a cable main body 72 and an auxiliary plate 73 stuck to one surface at an end portion in a longitudinal end of the cable main body 72 (the upper surface as viewed in FIG. 9). The auxiliary plate 73 is formed of material having a relatively high hardness, such as polyimide or the like, and covers one side surface of the cable main body 72 throughout a predetermined range in the longitudinal direction and the entire range in the widthwise direction. Lug parts 74 projecting outward are formed on both sides in the longitudinal end of the flat cable 71.

A plurality of, for example, eleven pieces of lead-wires 75 in the form of foil, having conductivity are disposed in parallel at a predetermined pitch, for example, at the pitch of about 0.3 mm, on an insulating layer indicating electrical insulating property of the cable main body 72. The upper sides (the lower sides as viewed in FIG. 9) of the lead-wires 75 are covered with another insulating layer. At the end portion of the flat cable 71 which is inserted into the inserting holes 33 of the connector 10, the upper surfaces of the lead-wires 75 (the lower surfaces as viewed in FIG. 9) are exposed throughout a predetermined range in the longitudinal direction. In the example shown in FIGS. 9 to 13, it is assumed that the lead-wires 75 are exposed on the lower surface of the flat cable 71.

When connecting the flat cables 71 to the connector 10, firstly, the longitudinal end of the flat cable 71 is inserted into the inserting holes 33 of the housing 31. In this case, as shown in FIG. 1, the actuator 11 is situated in the open position in advance. An operator then shifts the longitudinal end of the flat cable 71 to the inserting holes 33 of the housing 31. This enables insertion of the longitudinal end of the flat cable 71 into the inserting holes 33. At this time, the flat cable 71 is moved with the exposed surfaces of lead-wires 75 facing down.

The tip of the flat cable 71 is then inserted into a space between the upper arm parts 44 and the lower arm parts 43 of the first terminals 41 being accommodated in the first terminal receiving grooves 34*a*, and into a space between the upper arm parts 54 and the lower arm parts 53 of the second terminals 51 being accommodated in the second terminal receiving grooves 34*b*. At this time, the tip of the flat cable 71 abuts on the abutting parts 38 being disposed at the back in the inserting holes 33, and thereby the longitudinal positioning of the flat cable 71 is accomplished, resulting in the completion of the insertion of the flat cable 71.

Subsequently, an operator manipulates the actuator 11 with fingers or the like to change its orientation from the open position to the closed position. The front end of the main body 15 is then lowered, and the tip edges 16*a* of the locked portions 16 of the main body 15 abut on the tip edges 23*a* of the locking portions 23, as shown in FIGS. 9 and 10. At this time, the force in the direction indicated by the arrow G in FIG. 9 is added on the front end of the main body 15.

In addition, the rear ends of the pressing parts 14 abut on the surface in the opposite side from the lead-wires 75 of the flat cable 71. At this time, since the actuator 11 changes its position in a counterclockwise direction in FIG. 9, the rear ends of the pressing parts 14 interfere with the flat cable 71, and thereby the actuator 11 is subjected to the force in the direction indicated by the arrow H in FIG. 9. Therefore, the main body 15 is moved toward the front side of the connector 10 and, with the tip edges 16*a* of the locked portions 16 abutted on the tip edges 23*a* of the locking portions 23, the main body 15 shifts to the front side of the locking portions 23, namely the side at which the distance between the right and left tip edges 23*a* is narrow. This causes the distance between the right and left tip edges 23*a* to be spread out by the locked portions 16. In this case, since the locking portions 23 are formed from the plate-like main body 22 to the inside of the connector 10 and thereby can resiliently deform to a certain degree, the right and left tip edges 23*a* are displaced in the direction indicated by the arrows I in FIG. 10.

As stated above, while gradually spreading out the distance between the right and left tip edges 23*a* through the locked portions 16, the actuator 11 changes its orientation in the counterclockwise direction so as to be situated in the closed position approximately parallel to the insertion direction of the flat cable 71, as shown in FIGS. 11 and 12. In this case, the pressing parts 14 are pressed against the surface in the opposite side from the lead-wires 75 of the flat cable 71. Therefore, the lead-wires 75 being exposed on the lower surface of the flat cable 71 abut on the contact parts 43 of the first terminals 41 and the contact parts 53*a* of the second terminals 51 to form electrical connecting parts, and the lead-wires 75 are electrically connected to the first terminals 41 and the second terminals 51, thereby being conductive with the conductive traces of the substrate, through the connecting pads or the like on the surface of the substrate to which the tail parts 42 and the tail parts 52 are connected. This results in the completion of the connection of the flat cable 71 to the connector 10.

In this state, since the locking portions 23 hang over the locked portions 16 formed on both sides of the main body 15 of the actuator 11, the actuator 11 is locked in the closed position. This prevents the actuator 11 from unnecessarily opening, even if the external force such as vibration, shock, or the like is added on the connector 10. In addition, an operator can easily discriminate by visual checking whether or not the locking portions 23 hang over the locked portions 16. Hence, by visually checking that the locking portions 23 hang over the locked portions 16, it is possible to easily confirm that the connection of the flat cable 71 to the connector 10 was completed.

In case of opening the actuator 11 of the connector 10 with the flat cable 71 connected thereto, if an operator manipulates the actuator 11 with fingers or the like, the force in the direction indicated by the arrow 3 in FIG. 13 is added on the front end of the main body 15 of the actuator 11. In this case, since the pressing parts 14 are pressed against the flat cable 71, the main body 15 does not shift toward the rear side of the connector 10. Therefore, since the locked portions 16 of the main body 15 do not shift to the rear side of the locking portions 23, namely the side at which the distance between the right and left tip edges 23*a* is wide, an amount of hanging of the locking portions 23 over the locked portions 16 becomes large. Consequently, it is difficult to release the hanging of the locking portions 23 over the locked portions 16, preventing the lock of the actuator 11 from being easily released.

Since this prevents the actuator 11 from being easily opened when the flat cable 71 is connected thereto, the connection of the flat cable 71 to the connector 10 can be certainly maintained. For example, in operation after having connected the flat cable 71 to the connector 10, even if the operator's fingers catch the front end of the main body 15 of the actuator 11, the unnecessary opening of the actuator 11 is assuredly prevented.

As described above, in the present embodiment, the actuator 11 has the locked portions 16 disposed on both sides of the main body 15, and the locking portions 23 engaged with the locked portions 16 in the closed position are disposed on both sides of the housing 31, while the tip edges 16*a* of the locked portions 16 are parallel to the direction of insertion-and-extraction of the flat cable 71 in the closed position, and the tip edges 23*a* of the locking portions 23 incline to the direction of insertion-and-extraction of the flat cable 71.

Since this enables, in spite of simple construction, to easily perform the operation of changing the orientation of the actuator 11 to the closed position, and to ensure the locking of the actuator 11 so that the actuator 11 may not be unnecessarily opened from the closed position to change its orientation, it is possible to assuredly connect the flat cable 71.

The tip edges 23*a* of the locking portions 23 on both sides face each other, and the distance therebetween is narrow nearer the inlet sides of the inserting holes 33, namely the front side. Therefore, in opening the actuator 11 from the closed position, if the actuator 11 is shifted backward, it is possible to easily open the actuator 11.

Furthermore, the tip edges 23*a* of the locking portions 23 on both sides face each other, and are resiliently displaceable in the direction to widen the distance therebetween. Therefore, in opening the actuator 11 from the closed position, and in situating the actuator 11 in the closed position, the distance between the right and left tip edges 23*a* is spread out, and the locked portions 16 can pass the space between the tip edges 23*a*.

Furthermore, the tip edges 23*a* of the locking portions 23 on both sides are displaceable obliquely upward. For that reason, in comparison to the case of rendering the tip edges 23*a* to displace transversely, even the narrow width of the space for absorbing the displacement of the tip edges 23*a* may be sufficient, and therefore it is possible to narrow the width of the housing 31.

In addition, the locking portions 23 are formed at the auxiliary connector securing members 21 mounted on both sides of the housing 31. This enables a reduction in the number of parts, an increase in the strength of the locking portions 23, and elastic displacement of the tip edges 23*a* of the locking portions 23.

Also, the locking portions 23 hang over the locked portions 16 in the closed position. This prevents the actuator 11 from being unnecessarily opened, even if the external force such as vibration, shock or the like is added on the connector 10.

Furthermore, when the flat cable 71 is not inserted into the inserting holes 33, the actuator 11 is movable toward the backs of the inserting holes 33 in the closed position and in the position adjacent to the closed position. For that reason, since the locked portions 16 of the main body 15 shift to the side at which the distance between the right and left tip edges 23*a* of the locking portions 23 is wide, the amount of hanging of the locking portions 23 over the locked portions 16 is reduced, and thereby it is possible to relatively easily open the actuator 11.

In addition, the actuator 11 is subjected to the force toward the backs of the inserting holes 33 when the tip edges 16*a* of the locked portions 16 abut on the tip edges 23*a* of the locking portions 23 in the position adjacent to the closed position. Therefore, since the locked portions 16 are moved to the rear sides of the locking portions 23, and as a result, the amount of hanging of the locking portions 23 over the locked portions 16 is further reduced, it enables to relatively easily open the actuator 11.

Furthermore, the actuator 11 contains the pressing parts 14 pressing the flat cable 71 against the contact parts 43*a* and the contact parts 53*a*, and the actuator 11 cannot move toward the backs of the inserting holes 33 in the closed position and in the position adjacent to the closed position when the flat cable 71 is inserted into the inserting holes 33. Accordingly, since the locked portions 16 of the main body 15 do not shift to the side at which the distance between the right and left tip edges 23*a* of the locking portions 23 is wide, the amount of hanging of the locking portions 23 over the locked portions 16 is large, thereby preventing the lock of the actuator 11 from being easily released.

While the present invention has been described with reference to certain embodiments, it will be understood by those skilled in the art that various changes and substitutions may be made and equivalents may be used without departing from the spirit and scope of the invention. It is therefore intended that the invention not be limited to the particular embodiment disclosed, but that the invention will include all embodiments falling within the scope of the appended claims.

What is claimed is:

1. A cable connector comprising:

a housing provided with an inserting hole through which a flat cable is to be inserted;

terminals being mounted on the housing and provided with contact parts to be electrically connected to lead-wires of the flat cable;

an actuator moveable between a first position to enable insertion of the flat cable and a second position to connect the lead-wires of the inserted flat cable to the contact parts, the actuator having a main body being nearly parallel to a direction of insertion-and-extraction of the flat cable when said actuator is in the second position, and locked portions being disposed on opposite sides of the main body; and locking portions being disposed on both sides of the housing and being engaged with the locked portions when said actuator is in the second position, wherein:

said locked portions including tip edges extending parallel to the direction of insertion-and-extraction of the flat cable when said actuator is in the second position, and said locking portions including tip edges inclined to the direction of insertion-and-extraction of the flat cable wherein the tip edges of the locking portions on both sides face each and a distance therebetween becomes narrower as being situated nearer an inlet side of the inserting hole.

2. The cable connector according to claim 1, wherein the locking portions are formed as part of auxiliary connector securing members, each being mounted on opposite sides of the housing.

3. The cable connector according to claim 1, wherein the actuator is movable toward a back of the inserting hole in the second position and in the position adjacent to the second position, when the flat cable is not inserted into the inserting hole.

4. The cable connector according to claim 1, wherein the actuator is provided with a pressing part pressing the flat cable against the contact part, and is unmovable toward the back of the inserting hole in the second position and in the position adjacent to the second position, when the flat cable is inserted into the inserting hole.

5. The cable connector according to claim 1, wherein the tip edges of the locking portions on both sides [face each other and] are resiliently displaceable in a direction toward widening a distance therebetween.

6. The cable connector according to claim 5, wherein the tip edges of the locking portions on both sides are displaced obliquely upward.

7. The cable connector according to claim 1, wherein the locking portions hang over the locked portions where said actuator is in the second position.

8. The cable connector according to claim 7, wherein the actuator is subjected to a force toward the back of the inserting hole in the position adjacent to the second position, when the tip edges of the locked portions abut on the tip edges of the locking portions.

* * * * *